US008033491B2

(12) United States Patent
Solomon et al.

(10) Patent No.: US 8,033,491 B2
(45) Date of Patent: Oct. 11, 2011

(54) TOP SERVICE GYRATORY CRUSHER

(75) Inventors: Mark Solomon, Bethlehem, PA (US); Christopher K. Littleford, Bethlehem, PA (US)

(73) Assignee: FLSmidth A/S (DK)

( * ) Notice: Subject to any disclaimer, the term of this patent is extended or adjusted under 35 U.S.C. 154(b) by 0 days.

(21) Appl. No.: 12/154,357

(22) Filed: May 22, 2008

(65) Prior Publication Data

US 2009/0289135 A1 Nov. 26, 2009

(51) Int. Cl.
*B02C 15/10* (2006.01)
*B02C 17/08* (2006.01)

(52) U.S. Cl. ..... 241/209; 241/215; 241/216

(58) Field of Classification Search ..... 241/207, 241/209–216
See application file for complete search history.

(56) References Cited

U.S. PATENT DOCUMENTS

| | | | | |
|---|---|---|---|---|
| 2,667,309 | A * | 1/1954 | Becker | 241/211 |
| 2,941,732 | A * | 6/1960 | Cross et al. | 241/101.3 |
| 3,133,707 | A * | 5/1964 | Zimmerman | 241/37 |
| 3,666,188 | A * | 5/1972 | Lippmann | 241/213 |
| 4,060,205 | A * | 11/1977 | Pollak | 241/211 |
| 4,339,087 | A * | 7/1982 | Pollak | 241/211 |
| 4,681,269 | A * | 7/1987 | Arakawa | 241/101.2 |
| 6,446,977 | B1 * | 9/2002 | Thiede | 277/501 |
| 6,536,693 | B2 * | 3/2003 | Van Mullem et al. | 241/209 |

* cited by examiner

*Primary Examiner* — Bena Miller
(74) *Attorney, Agent, or Firm* — Daniel DeJoseph; Aaron Pile; Jeffrey Sharp

(57) ABSTRACT

The apparatus is a gyratory crusher in which all the wear parts can be removed and replaced from the top of the crusher, thus eliminating the need to remove large, heavy parts from below the crusher. This is accomplished by constructing the crusher so that the eccentric and the piston assembly can be lifted up and out sequentially. The piston assembly then includes all the wear parts within the lowest assembly, the hydraulic support, so that those parts can be replaced without access to the underside of the crusher. If necessary, the hydraulic support within which the piston assembly is held can also be removed from above the crusher.

6 Claims, 3 Drawing Sheets

TOP SERVICE GYRATORY CRUSHER

BACKGROUND OF THE INVENTION

This invention deals generally with gyratory crushers, and more specifically with a gyratory crusher for which all regular service and parts replacement can be accomplished from above the crusher.

Gyratory crushers are well established machines that are used for crushing rocks, ore, and other materials. They are very large and their basic structure comprises a bowl shaped as a cone with the wider end of the cone near the top of the crusher. A conical head assembly is located on the axis of the bowl, and the head assembly is oriented so that its smaller dimension is at the top of the crusher. To perform the crushing action, independent motions are applied to the conical head assembly. The first is rotation and the second is gyration.

In the typical gyratory crusher, large material is fed into the top between the large opening of the bowl and the small end of the head assembly where the volume is largest. The gyration of the head assembly is furnished by an eccentric drive, the rotation is driven by a gear, and vertical support and minor vertical adjustment is furnished by a hydraulic support. All these parts are located at the bottom of the crusher at the bottom of the conical head assembly. The combination of the rotation and the gyration applies forces that crush the pieces of material, and they fall lower into the reduced space within the bowl as they are reduced in size. Ultimately the material leaves the crusher through openings at the bottom of the crusher.

The hydraulic support assemblies on most gyratory crushers are large, heavy hydraulic cylindrical casings with robust bronze bushings, and they are located below the head assembly and the eccentric and gear drives. To service the wear parts of such a hydraulic support, it needs to be removed from the crusher, and to do this the assembly must be unbolted from the crusher frame and lowered onto a cart or other device which can move it out from beneath the crusher. This procedure is dangerous and time consuming because it requires personnel to be beneath the crusher to guide the movement of the hydraulic support while the crusher and the hydraulic support are being supported. Working below the crusher can expose personnel to hazards such as a poor visibility, poor communication, falls and tripping, high dust exposure, and rock falls.

It would be very beneficial to have a gyratory crusher that did not require access below the machine for scheduled and emergency service of the hydraulic support assembly and for removal of the eccentric drive, and other equipment.

SUMMARY OF THE INVENTION

The gyratory crusher of the present invention provides access for virtually all service through the top of the machine. The invention thereby eliminates the risks to personnel from working below the crusher, because the conical head assembly, the eccentric assembly, and the hydraulic support assembly, which comprises a piston assembly within and supported by a cylindrical support, are all removable through the top of the crusher. Furthermore, in the preferred embodiment the hydraulic support assembly is constructed so that the internal piston assembly contains essentially all the designed wear parts typically located within the hydraulic support assembly. In prior art crushers some of these wear parts are designed to be located on the cylindrical support. Such a preferred embodiment limits the need to remove the cylindrical support of the hydraulic support assembly in order to replace the designed wear parts. Of course, if necessary the cylindrical support also is removable through the top of the crusher.

To accomplish this top access feature, the eccentric assembly and the cylindrical support are each constructed to pass through the crusher frame structure. The basic configuration of each of the eccentric assembly and the cylindrical support is a cylinder with a circumferential lip protruding outward from the top edge of the cylinder. Such a structure permits each of these parts to be supported by a circumferential ledge built into the crusher. The other requirement to assure that the parts can be lowered into place and removed from above the crusher is that the outside diameter of the uppermost part, the eccentric assembly, must be larger than the outside diameter of the cylindrical support which must pass through the location formerly occupied by the eccentric assembly after the eccentric assembly is removed. That is, the cylindrical support must be sized to pass through the opening left after the eccentric assembly is removed.

The hydraulic assembly, comprising the cylindrical support and piston assembly, is located below the crusher and constructed with a tight fit and seal. The piston assembly fits within the cylindrical support and can be removed from within the cylinder support. The piston assembly can be removed with the eccentric assembly in place or with the eccentric assembly first removed.

The preferred embodiment of the present invention provides the particular benefit of having all the designed wear parts of the hydraulic support installed on the piston assembly. These include a piston wear ring, one or more hydraulic seals, and upper and lower piston bushings, with the latter two parts normally located on prior art cylindrical supports. The resulting advantage of this design is that that all such wear parts can be replaced at the same time, such as when the piston assembly is at a workbench. The piston assembly and wear parts can be serviced without requiring removal of the cylinder housing. In fact, the least time consuming service method is to have another piston assembly with new wear parts available at the crusher, and to replace the whole piston assembly immediately, so the replacement of the wear parts can take place independently of servicing the crusher.

The combination of service access from the top of the crusher and all the designed wear parts on only one piston assembly thus provides an apparatus which is both exceptionally safe and very efficient to service.

DETAILED DESCRIPTION OF THE INVENTION

Figure 1:
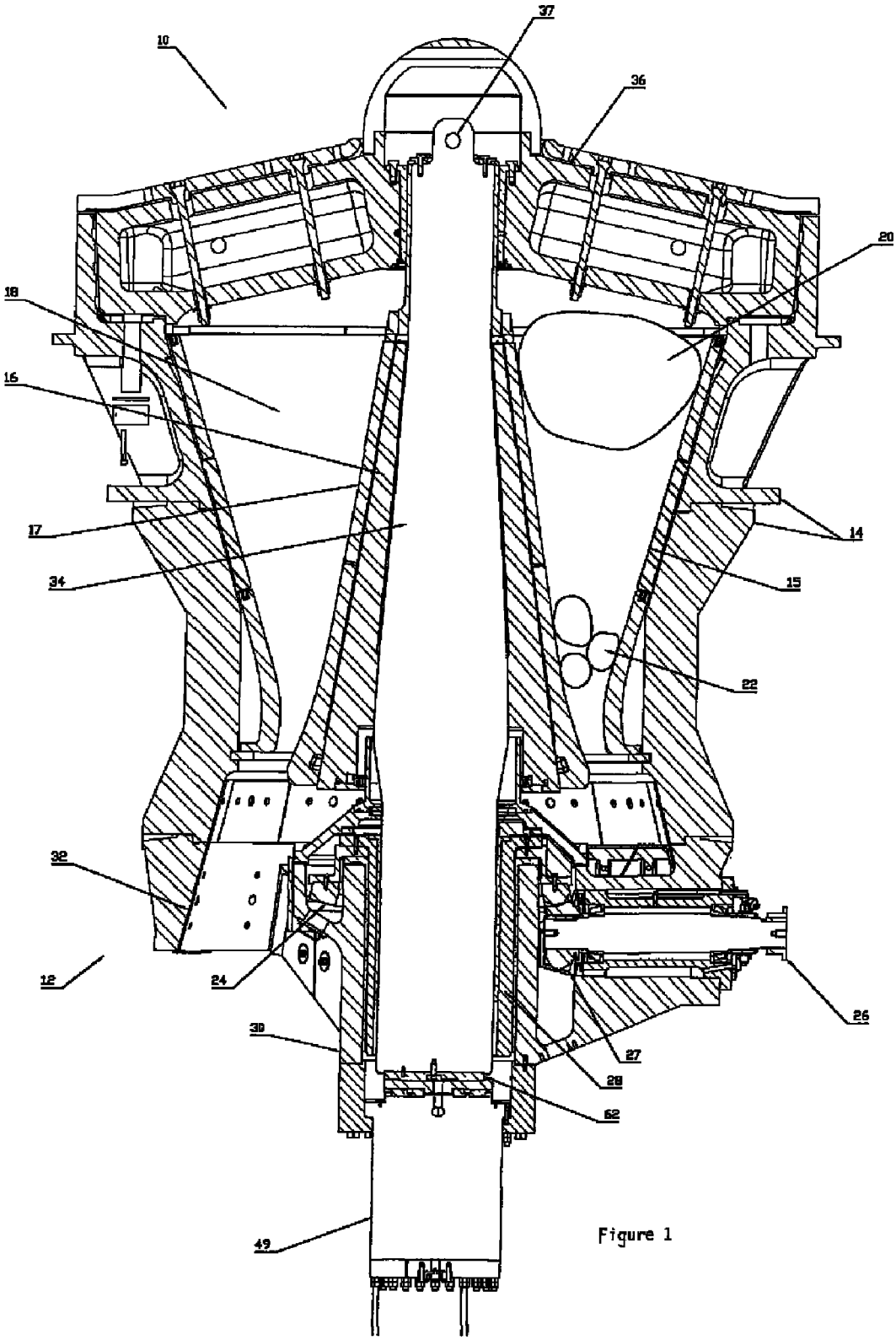
FIG. 1 is a partial cross section view of the preferred embodiment of the gyratory crusher of the invention.

FIG. 1 is a partial cross section view of the preferred embodiment of gyratory crusher 10 of the invention. It should be understood that except for the specific construction of lower portion 12 of crusher 10, the crusher is constructed and operates similarly to prior art crushers. The basic structure of crusher 10 includes bowl or shell 14 shaped as a cone with its wider opening at the top, and head assembly 16 which is located on the axis of bowl 14. Head assembly 16 is shaped as a cone and has its larger diameter at the lower end of bowl 14 so that together bowl 14 and head assembly 16 form crushing volume 18 which is larger at the top and smaller at the lower end. This configuration permits larger material 20 to be fed into the top of crusher 10, and it falls to the bottom of bowl 14 as it is crushed into smaller pieces 22 and exits crusher 10. Both bowl 14 and head assembly 16 have replaceable working surfaces. Bowl 14 has a liner 15, called a "concave" in the industry, and head assembly 16 has a liner 17 referred to as a "mantle".

Head assembly 16 is located by an eccentric assembly 28 which is rotated by ring gear 24 which is conventionally driven through drive gear 27 and drive shaft 26. Eccentric assembly 28, within which the lower portion of main shaft 34 is held, imparts to head assembly 16 an eccentric motion, essentially a gyration, for crusher 10 to function. The motion is imparted to head assembly 16 by eccentric assembly 28 that has an eccentric center volume, although eccentric assembly 28 is itself cylindrical and mounted in centered cylindrical support hole 31 within center hub 30. Eccentric assembly 28 along with annular shell 32, are part of the bottom support structure of crusher 10. Eccentric assembly 28 rotates about center hole (31) and, as eccentric assembly 28 rotates, its eccentric center volume moves the bottom end of mainshaft 34 in an eccentric path imparting the gyratory motion to head assembly 16.

Mainshaft 34 of head assembly 16 fits into and is attached to eccentric assembly 28, and, at the top of crusher 10, mainshaft 34 is located by bushings or bearings within spider 36, which is the upper support member of crusher 10. Eccentric assembly and mainshaft 34 are supported from below eccentric assembly 28 by hydraulic support assembly 49, which is discussed with the following details of the present invention.

Figure 2:
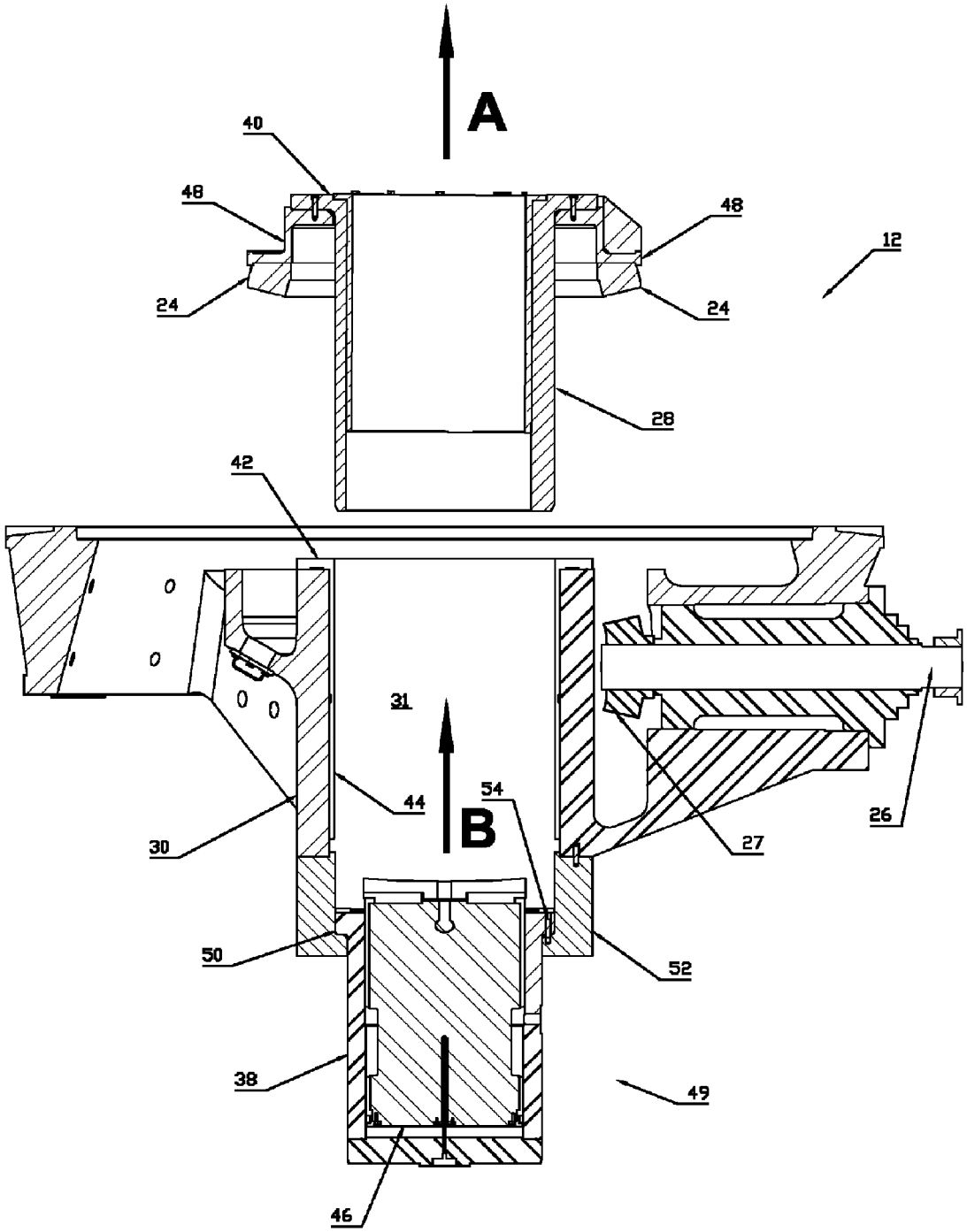
FIG. 2 is a partial cross section view of the lower portion of the gyratory crusher of the invention showing the eccentric assembly being removed and the hydraulic support installed in its working location.

FIG. 2 is a partial cross section view of lower portion 12 of gyratory crusher 10 showing hydraulic assembly 49 which is comprised of cylindrical support 38 and piston assembly 46. Eccentric assembly 28 is shown being removed from center hub 30 by being lifted straight up in direction A, while cylindrical support 38 remains installed in its working location. The lifting typically is performed by use of a crane after spider 36 and head assembly 16 (FIG. 1) have previously been lifted out by the use of a crane. Mainshaft 34 has lifting hole 37 (FIG. 1) formed in its uppermost region to facilitate its lifting.

Returning to FIG. 2, when eccentric assembly 28 is installed in cylindrical center hole 31 within center hub 30, top support ring 40 of eccentric assembly 28 is supported by eccentric wear ring 42 at the top of center hub 30. Eccentric wear ring 42 is integrated with outer eccentric bushing 44 and they both act as bearing surfaces for the rotation of eccentric assembly 28. Ring gear 24 is also shown attached to eccentric assembly 28 by gear support 48.

FIG. 2 also shows cylindrical support 38 in cross section with piston assembly 46 in place within cylindrical support 38. The hydraulic supports of prior art gyratory crushers require removal from below. The present invention is constructed to permit cylindrical support 38 to be serviced and removed from the top of crusher 10.

One feature that permits removal of cylindrical support 38 from above is that the cylindrical support includes circumferential upper lip 50. Upper lip 50 is then supported by protruding support frame ledge 52 so that cylindrical support 38 can be lifted up out of its position in direction B. However, a further requirement of cylindrical support 38 is that its largest diameter, measured as the straight line distance between opposite points on the outer circumference of upper lip 50, must be smaller than the diameter of center hole (31), which corresponds to the inner diameter of eccentric bushing 44, measured as the straight line distance between opposite points on the inner surface of eccentric bushing 44, to permit the passage of cylindrical support 38 through support hole 31 and out of crusher 10. Put another way, assuming FIG. 2 to be vertically situated, the largest horizontal dimension of the cylindrical support (38) must be less than and subsequently clear the smallest horizontal dimension within center hole (31). Of course, if the cylindrical support 38 can be thus removed from above the piston assembly, which fits within the cylindrical support, is also removable from above, with or without the cylindrical support being removed.

Such a configuration permits removal of cylindrical support 38 from crusher 10 without the previously required access from underneath such crushers. However, the present invention also dramatically reduces the need for removing the cylindrical support 38 because of the design of piston assembly 46, which is the operational portion of hydraulic assembly 49. In the prior art such removal of the hydraulic assemblies was required on a regular basis so that the several parts within a cylindrical support which were designed to be subject to wear, specifically piston bushings, could be replaced. However, in the present invention, all the parts within hydraulic assembly 49 which are normally designed to be subject to wear are now actually part of piston assembly 46, so that it is usually necessary to remove only piston assembly 46 from crusher 10 to replace the wear parts. Under such circumstances, cylindrical support 38 may be left in its operating position.

As can be seen in FIG. 2, piston assembly 46 has an outside diameter that is significantly smaller than the inside diameter of eccentric bushing 44. This size relationship makes it quite easy to lift piston assembly 46 up out of hydraulic support 38 and remove it from crusher 10 for service.

Figure 3:
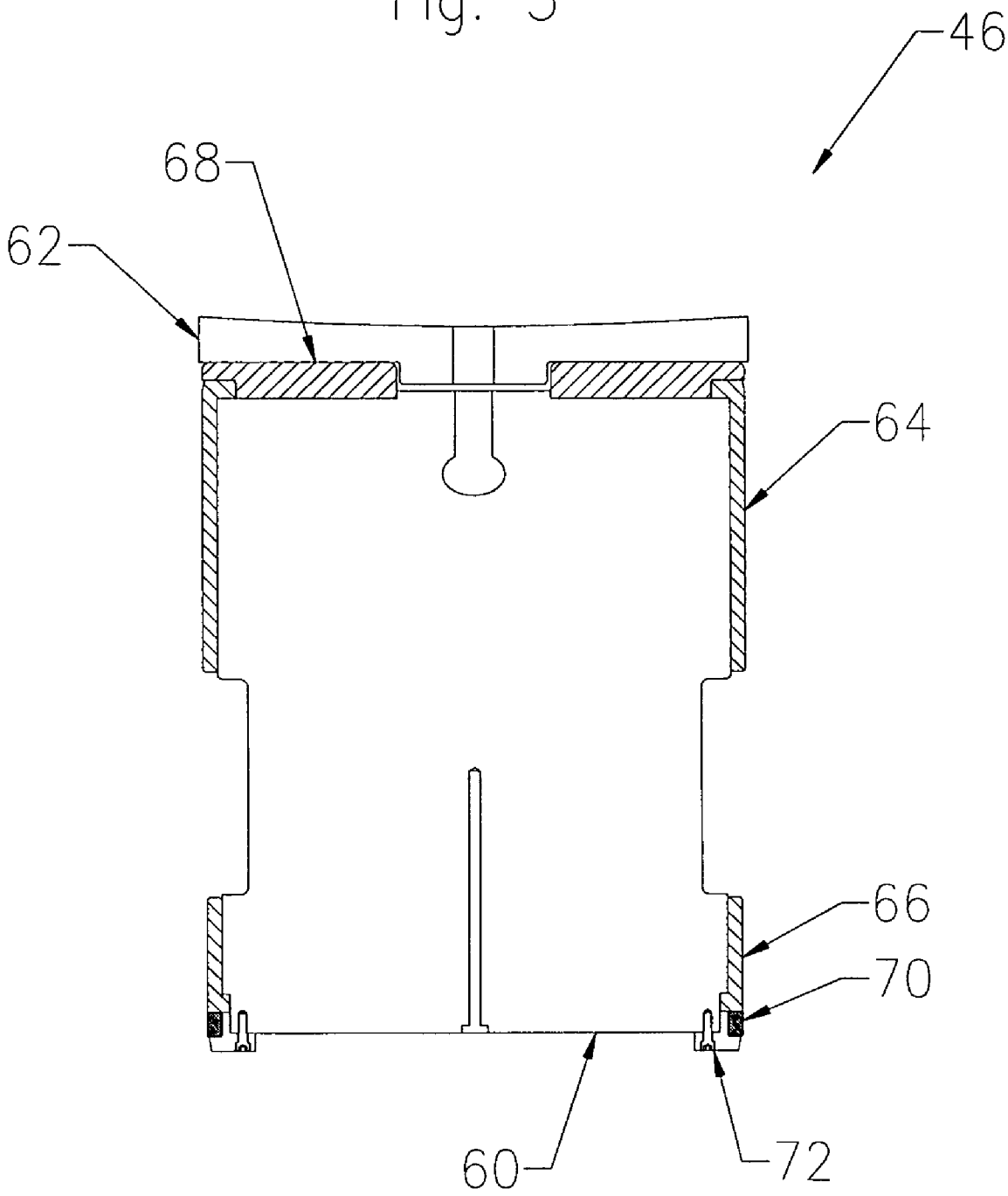
FIG. 3 is a partial cross section view of a piston assembly showing the locations of the wear components.

FIG. 3 is a partial cross section view of piston assembly 46 showing the locations of the wear components. Piston 60 is the major part upon which all the other components are mounted. The designed wear parts located on piston assembly 46 are upper piston bushing 64, lower piston bushing 66, hydraulic seal 70, and piston wear ring 68. Center wearing ring 62 is the contact and support element for mainshaft 34 and thus head assembly 16 (FIG. 1), and upper piston bushing 64 and lower piston bushing 66. Upper piston bushing 64 and lower piston bushing 66, which in prior art designs were located on the cylindrical support, are the sliding contact surfaces between the outer diameter of piston assembly 46 and the inner diameter of cylindrical support 38. Piston wearing ring 68 is configured to hold upper piston bushing 64 in place and also serves as a support for center wearing ring 62. Hydraulic seal 70 is held in its location by retaining ring 72 and serves to prevent hydraulic fluid form leaking past piston assembly 46 instead of applying force to move it. Optionally, to facilitate easy installation of complete piston assembly (46) from above, piston assembly 46 can be constructed so that its upper piston bushing 64 has a larger diameter than the larger diameter of lower piston bushing (66) or piston seal (70). Typically, the differences will be comparatively small, and the diameter of upper piston bushing 64 be only about 1% to about 3% larger than the above referenced larger diameter.

As can be seen in FIG. 3, all of the designed wear parts are easily accessible when piston assembly 46 is removed from cylindrical support 38, and that removal is easily performed from above crusher 10. The invention thereby provides a gyratory crusher which can be serviced efficiently and, by avoiding the requirement for working underneath the crusher, can be serviced safely.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

What is claimed:

1. A gyratory crusher comprising:

a bowl (14) shaped as a cone with its wider opening approaching the top of the crusher;

a head assembly (16) shaped as a cone, centrally located within the bowl and having its larger diameter at the lower end of the bowl, so that the bowl and head assembly form a crushing volume (18) which is larger at the top and smaller at the lower end, with the head assembly including a central mainshaft (34) which is located on an inclined axis within the bowl;

a spider (36) located at the top of the crusher functioning as the upper support member of the crusher and including bushings or bearings within which an upper portion of the mainshaft is captured;

a cylindrical eccentric assembly (28) including an eccentric central volume in which the main shaft is held so that, as the eccentric assembly rotates, the mainshaft gyrates, with the eccentric assembly rotating about a center hole (31) within a central hub (30) of the crusher, said eccentric assembly being sized to be removable from above the crusher after spider (36) and head assembly (16) have been removed from above;

a ring gear (24) attached to and rotating the eccentric assembly with the ring gear driven by a drive gear (27) and a drive shaft (26);

a hydraulic support assembly (49) comprising a piston assembly 46 installed within a cylindrical support 38, said hydraulic support assembly installed below and supporting the head assembly (16) and cylindrical eccentric assembly (28), with the cylindrical support supported by a support frame ledge (52) protruding inward from the structure of the crusher, and with the cylindrical support being sized to be able to clearly pass upward through center hole (31) to thereby be removable from above the crusher after the eccentric assembly is removed.

2. The gyratory crusher of claim 1 wherein the piston assembly is separable from the cylindrical support and, when so separated, the cylindrical support does not contain the designed wear parts comprising a piston wear ring, at least one hydraulic seal, and upper and lower piston bushings, with said wear parts being contained on the piston assembly.

3. The gyratory crusher of claim 1 wherein the piston assembly contains the designed wear parts comprising a piston wear ring, at least one hydraulic seal, and upper and lower piston bushings within the hydraulic support assembly.

4. The gyratory crusher of claim 1 wherein the piston assembly has an upper piston busing (64) and a lower piston bushing (66), with the upper piston bushing (64) having a larger diameter than the diameter of the lower piston bushing (66) or the piston seal (70) to facilitate the easy removal of the piston assembly (46) from above the crusher independent of removing the cylindrical support.

5. A gyratory crusher comprising:

a bowl (14) shaped as a cone with its wider opening approaching the top of the crusher;

a head assembly (16) shaped as a cone, centrally located within the bowl and having its larger diameter at the lower end of the bowl, so that the bowl and head assembly form a crushing volume (18) which is larger at the top and smaller at the lower end, with the head assembly including a central mainshaft (34) which is located on an inclined axis within the bowl;

a spider (36) located at the top of the crusher functioning as the upper support member of the crusher and including bushings or bearings within which an upper portion of the mainshaft is captured;

a cylindrical eccentric assembly (28) including an eccentric central volume in which the main shaft is held so that, as the eccentric assembly rotates, the mainshaft gyrates, with the eccentric assembly rotating about a center hole (31) within a central hub (30) of the crusher;

a ring gear (24) attached to and rotating the eccentric assembly with the ring gear driven by a drive gear (27) and a drive shaft (26); and a hydraulic support assembly (49) comprising a piston assembly 46 installed within a cylindrical support 38, said hydraulic support assembly installed below and supporting the head assembly (16);

said piston assembly containing designed wear parts comprising an upper piston bushing (64), lower piston bushing (66), piston wear ring (68) and hydraulic seals (70), with the upper piston bushing (64) having a larger diameter than the diameter of the lower piston bushing (66) or the hydraulic seal (70) to facilitate the easy removal of the piston assembly (46) from above the crusher.

6. The gyratory crusher of claim 5 wherein the cylindrical support is supported by a separate support frame ledge (52) protruding inward from the structure of the crusher, with the largest horizontal dimension of the cylindrical support being less than and clearing the smallest horizontal dimension within center hole (31) which is located above the cylindrical support.

* * * * *